US006113774A

United States Patent [19]

Eastman et al.

[11] Patent Number: 6,113,774

[45] Date of Patent: Sep. 5, 2000

[54] ANTIFOULANT CONTROL PROCESS

[75] Inventors: Alan D. Eastman; Ronald E. Brown, both of Bartlesville, Okla.

[73] Assignee: Phillips Petroleum Company, Bartlesville, Okla.

[21] Appl. No.: 09/083,720

[22] Filed: May 22, 1998

[51] Int. Cl.[7] ..... C10G 9/16; C10G 75/04

[52] U.S. Cl. ..... 208/48 R; 208/48 AA; 585/648; 585/833

[58] Field of Search ..... 208/48 R, 48 AA, 208/130; 585/648, 833

[56] References Cited

U.S. PATENT DOCUMENTS 4,376,694 3/1983 Lohr et al. ..... 208/48 R
4,420,343 12/1983 Sliwka ..... 134/22.15
4,775,459 10/1988 Forester ..... 208/48 AA
5,284,994 2/1994 Brown et al. ..... 585/648
5,435,904 7/1995 Reed et al. ..... 208/48 AA
5,734,098 3/1998 Kraus et al. ..... 73/61.62
5,851,377 12/1998 Bush ..... 208/48 AA

*Primary Examiner*—Bekir L. Yildirim
*Attorney, Agent, or Firm*—Ryan N. Cross

[57] ABSTRACT

A process is provided by the invention which comprises: (a) providing a tubular reactor having an inlet and an outlet, a furnace for heating the reactor, and a cooler having an inlet in communication with the reactor outlet and also having an outlet; (b) introducing a substantially constant flow of feed gas comprising steam to the reactor inlet while the reactor is heated by the furnace to produce a predetermined and substantially constant reactor outlet temperature; and (c) controlling, during at least a portion of (b), the concentration of an antifoulant in the feed gas based on cooler outlet temperature.

7 Claims, 1 Drawing Sheet

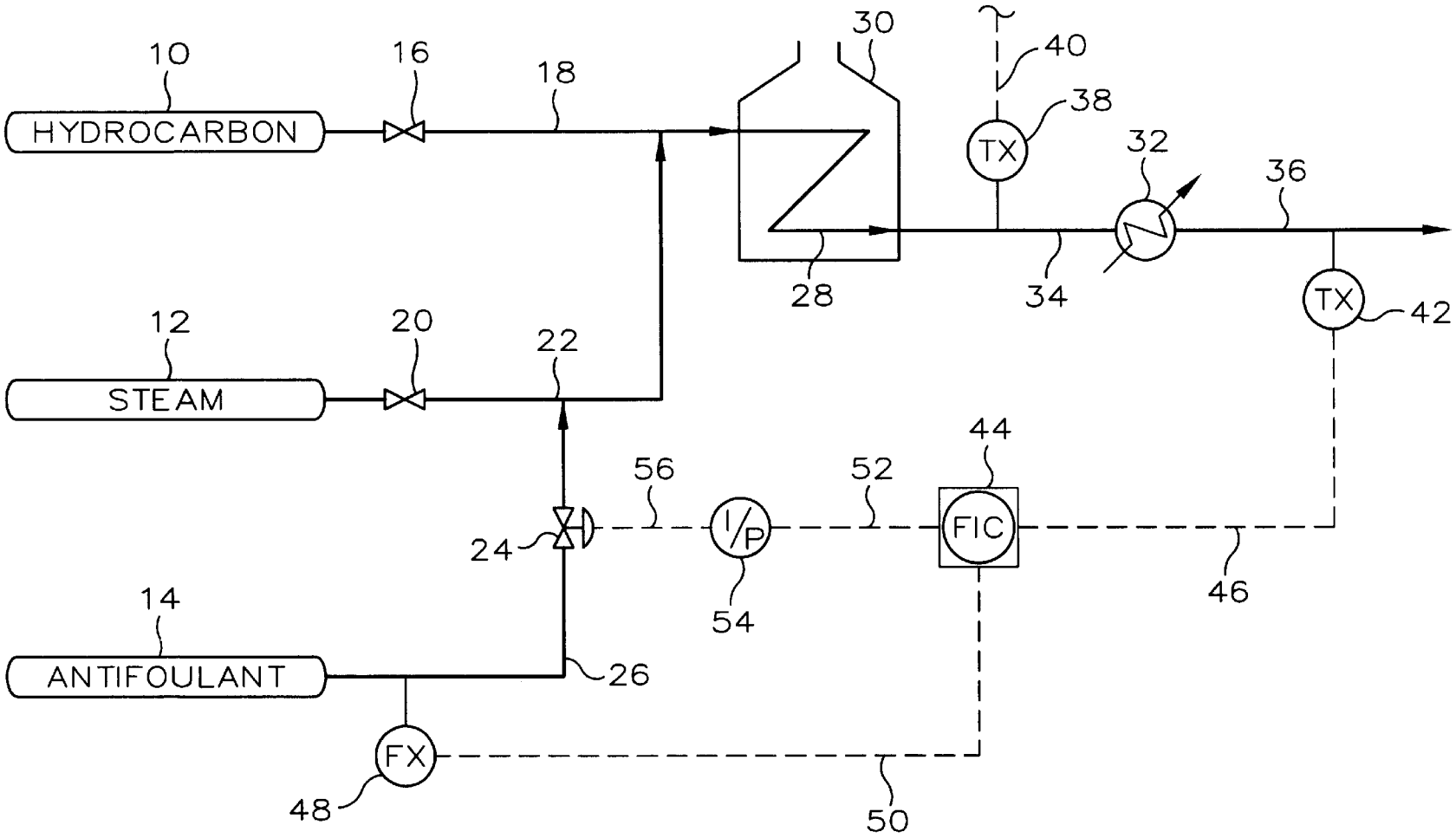
HYDROCARBON
STEAM
ANTIFOULANT
TX
TX
TX
FIC
I/P
FX
10
12
14
16
18
20
22
24
26
28
30
32
34
36
38
40
42
44
46
48
50
52
54
56

ANTIFOULANT CONTROL PROCESS

BACKGROUND OF THE INVENTION

The invention relates to treatment of a tubular reactor (i.e. a thermal cracking reactor) with antifoulant.

In a thermal cracking reactor, antifoulants alleviate the undesirable formation of coke and carbon dioxide during thermal cracking of hydrocarbons. Heretofore, there has been no procedure by which the concentration of antifoulant in the feed gas is controlled to ensure proper treatment of the reactor without unnecessary waste of antifoulant.

SUMMARY OF THE INVENTION

It is, therefore, an object of the invention to provide a process in which the concentration of antifoulant in a feed gas as introduced to a tubular reactor is controlled as discussed above.

The above object is realized by a process comprising: (a) providing a tubular reactor having an inlet and an outlet, a furnace for heating the reactor, and a cooler having an inlet in communication with the reactor outlet and also having an outlet; (b) introducing a substantially constant flow of feed gas comprising steam to the reactor inlet while the reactor is heated by the furnace to produce a predetermined and substantially constant reactor outlet temperature; and (c) controlling, during at least a portion of (b), the concentration of an antifoulant in the feed gas based on cooler outlet temperature.

The process of the invention can be applied to a feed gas comprising only steam (pretreatment) and/or to a feed gas comprising steam and at least one saturated hydrocarbon (cracking, assuming the reactor outlet temperature in (b) is in a suitable range).

The invention relies upon the discovery that the cooler outlet temperature will vary depending upon the amount of excess antifoulant (in excess of that required for treatment of the tubular reactor) in effluent flowing from the tubular reactor to the cooler. An increase in excess antifoulant, or simply the presence of excess antifoulant as opposed to no excess, results in a rise in cooler outlet temperature. According to a preferred embodiment, proper treatment of the tubular reactor without unnecessary waste of antifoulant is ensured by controlling the antifoulant concentration in (c) so as to maintain the cooler outlet temperature above an initial cooler outlet temperature but below an upper limit.

BRIEF DESCRIPTION OF THE DRAWING

The FIGURE is a schematic diagram of a system for performing the process of the invention.

DETAILED DESCRIPTION OF THE INVENTION

Referring to the FIGURE, a hydrocarbon source 10 supplies at least one saturated hydrocarbon as a gas, preferably having 2–8 carbon atoms per molecule. Suitable saturated hydrocarbons include, for example, ethane, propane, butane, and mixtures thereof. A steam source 12 supplies steam, preferably at a temperature of about 300–500° F. An antifoulant source 14 supplies antifoulant as a liquid. Suitable antifoulants include, but are not limited to, tetrahydrocarbyltin compounds, preferably tetra-n-butyltin. The tetrahydrocarbyltin compound can be combined with a silicon compound, such as hexamethyl disiloxane. A more complete list of suitable saturated hydrocarbons and antifoulants is provided in U.S. Pat. No. 5,435,904.

Valve 16 controls flow of hydrocarbon through line 18, valve 20 controls flow of steam through line 22, and diaphragm motor valve 24 controls flow of antifoulant through line 26.

Tubular reactor 28 is contained in a furnace 30 which heats the tubular reactor so as to produce a desired reactor outlet temperature. The reactor outlet is in communication with the inlet of cooler 32 through line 34. Cooler 32 is a heat exchanger (i.e. shell and tube or double pipe) which employs a suitable coolant fluid, and is sometimes referred to as a TLE (Transfer Line Exchanger). Line 36 extends from and is in communication with the outlet of cooler 32.

Temperature transducer 38 detects the reactor outlet temperature and generates an electrical signal representative thereof which is transmitted to a suitable monitor (not shown) via signal line 40. Temperature transducer 42 detects the cooler outlet temperature and generates an electrical signal representative thereof which is transmitted to computer and flow indicator and controller (hereafter denoted as computer/controller) 44 via signal line 46. The box represents the computer. Flow transducer 48 detects the flow rate of antifoulant through line 26 and generates an electrical signal representative thereof which is transmitted to computer/controller 44 via signal line 50. Computer/controller 44 processes temperature and flow data (as discussed further below) from transducers 42 and 48, respectively, and generates an electrical control signal which is transmitted via signal line 52 to I/P transducer 54. I/P transducer 54 converts the electrical signal to a pneumatic signal which is transmitted via signal line 56 to valve 24. Control of valve 24 by computer/controller 44 therefore controls the flow rate of antifoulant through line 26.

Automatic control of the antifoulant flow rate can be implemented during substantially all or at least a portion of a period, hereafter referred to as a constant ROT (Reactor Outlet Temperature) period, in which a substantially constant flow of feed gas (comprising only steam for pretreatment or steam and at least one saturated hydrocarbon for cracking) is introduced to the inlet of tubular reactor 28 while the reactor outlet temperature is held substantially constant. An initial cooler outlet temperature at approximately the commencement of a constant ROT period or thereafter during such period is designated as $T_1$ and any subsequent cooler outlet temperature is designated as $T_2$. $\Delta T=T_2-T_1$. Computer/controller 44 calculates $\Delta T$ at periodic intervals, generally about every five minutes. For each calculation, computer/controller 44 determines if $\Delta T$ is below a preselected minimum $\Delta T$ (which is greater than zero), above a preselected maximum $\Delta T$, or within the acceptable $\Delta T$ range defined by the minimum and maximum $\Delta T$. If $\Delta T$ corresponding to a current flow rate is below the minimum $\Delta T$, a new and higher antifoulant flow rate is calculated using a suitable algorithm in order to raise the concentration of antifoulant in the feed gas. If $\Delta T$ is above the maximum $\Delta T$, a new and lower antifoulant flow rate is calculated using the algorithm in order to lower the concentration of antifoulant in the feed gas. The algorithm has the $\Delta T$ value and current flow rate as input variables. Generally speaking, the magnitude of the difference between the calculated new flow rate and the current flow rate is proportional to how far $\Delta T$ is below the minimum $\Delta T$ or how far $\Delta T$ is above the maximum $\Delta T$. If $\Delta T$ is within the range defined by the minimum $\Delta T$ and the maximum $\Delta T$, the current flow rate and corresponding antifoulant concentration in the feed gas is unchanged. Accordingly, antifoulant concentration in the feed gas is automatically controlled so as to maintain $\Delta T$ within a range having a lower limit greater than zero, minimum $\Delta T$, and an upper limit, maximum $\Delta T$.

Typical operation of the illustrated system will now be described, wherein pretreatment is followed by cracking. Feed gas flow to the inlet of tubular reactor 28 is assumed to be substantially constant.

Valve 16 is closed and valve 20 is opened to the extent necessary to establish a desired flow rate of steam through line 22, and into and through a portion of line 18 to the inlet of tubular reactor 28. The feed gas to tubular reactor 28, therefore, comprises only steam. A first constant ROT period is started at a reactor outlet temperature in the range of about 1000–1300° F. A first $T_1$ is determined at approximately the commencement of the first constant ROT period. Valve 24 is opened to the extent necessary to establish an antifoulant flow rate which gives a preselected concentration of antifoulant in the feed gas of about 25–200 ppm. The term "ppm" as used herein assumes parts are in moles. Automatic control of antifoulant concentration is implemented during the first constant ROT period employing a minimum ΔT in the range of about 1–20° F. and a maximum ΔT in the range of about 50–150° F. The first constant ROT period and automatic control of antifoulant concentration ends after typically about 1 hour.

With valve 24 set at its last position in the first constant ROT period, the reactor outlet temperature is ramped to a temperature in the range of about 1400–1600° F. over a period of about 2–3 hours. A second constant ROT period starts and a second $T_1$ is determined at approximately the commencement of such period. Automatic control of antifoulant concentration is implemented during the second constant ROT period employing a minimum ΔT in the range of about 1–20° F. and a maximum ΔT in the range of about 50–150° F. The second constant ROT period and automatic control of antifoulant concentration ends after typically about 1 hour.

With valve 24 set at its last position in the second constant ROT period, the reactor outlet temperature is ramped upward about 50° F. to a desired cracking temperature in the range of about 1475–1650° F. Valve 16 is opened to the extent necessary to establish a desired flow rate of hydrocarbon through line 18. The flow rate of steam through line 22 is reduced so that the flow rate of feed gas, now comprising a mixture of steam and at least one saturated hydrocarbon, to tubular reactor 28 remains the same. The weight ratio of steam to hydrocarbon is preferably about 0.2:1–1:1.

A third constant ROT period starts as soon as the above cracking temperature is stabilized and a third $T_1$ is determined at approximately the commencement of the third constant ROT period or shortly thereafter. Automatic control of antifoulant concentration is implemented, employing a minimum ΔT in the range of about 1–10° F. and a maximum ΔT in the range of about 20–80° F. Automatic control can be continued for a predetermined amount of time, i.e. 1–10 days, (after which valve 24 can be left in its last position during automatic control), or until it is decided to close valve 24 and stop the flow of antifoulant when the inner surfaces of tubular reactor 28 are judged to be "passivated"; that is, inactive in catalyzing coke and carbon monoxide formation. A state of passivation is determined by monitoring the pressure drop across tubular reactor 28 and the concentration of carbon monoxide in the reactor effluent. The reactor effluent contains steam, the desired unsaturated hydrocarbon product resulting from the cracking of the saturated hydrocarbon, and also unconverted saturated hydrocarbon. Cooled reactor effluent flowing through line 36 frequently goes to additional coolers which are not shown.

An example will now be described to further illustrate the invention. This example should not be construed to limit the invention in any manner. Equipment included a tubular reactor, a furnace, and a cooler for receiving reactor effluent therethrough.

The example pertains to manual control (as opposed to automatic control described above) of antifoulant concentration in a feed gas comprising steam and ethane. The flow rate of ethane was 8 metric tons per hr. and the flow rate of steam was 2.4 metric tons per hr. to give a steam to ethane ratio of 0.3. The constant flow of feed gas was introduced to the inlet of the tubular reactor while the reactor was heated by the furnace to produce a constant reactor outlet temperature of 1550° F. At approximately the commencement of this constant ROT period, $T_1$ was determined to be 696° F. Antifoulant, comprising a liquid mixture of tetra-n-butyltin and hexamethyl disiloxane, was injected into the flow of feed gas at an initial concentration of 162 ppm. Minimum ΔT was to be at least above zero and maximum ΔT was about 35° F.

The antifoulant concentration was gradually reduced to 25 ppm over 3 hours, at which time ΔT was 38° F. At 3.5 hours, ΔT had risen to 42° F., above the maximum ΔT by 7° F. Therefore, the concentration was reduced to 20 ppm. However, at 4 hours, ΔT had risen to 44° F. The concentration was accordingly reduced to 15 ppm. At 4.5 hours, ΔT had dropped to 43° F. The concentration was reduced to 10 ppm, and at 6 hours ΔT had dropped to 34° F. This is within the desired range defined by minimum ΔT and maximum ΔT. The concentration was left at the 10 ppm level for 13 more hours.

The above example clearly illustrates how controlling the antifoulant concentration in accordance with the invention ensures proper treatment of the tubular reactor with antifoulant without wasting antifoulant.

Obviously, many modifications and variations of the present invention are possible in light of the above teachings. It is, therefore, to be understood that within the scope of the appended claims, the invention may be practiced otherwise than as specifically described.

That which is claimed is:

1. A process for controlling the concentration of an antifoulant in a feed stream introduced to a reactor suitable for the thermal cracking of hydrocarbons wherein the antifoulant is suitable for passivating the inner surfaces of the reactor and the reactor has an inlet and an outlet, comprising:

(a) heating the reactor with a furnace;

(b) providing a substantially constant flow of feed gas comprising steam;

(c) introducing the antifoulant into the feed gas to produce a feed stream;

(d) introducing the feed stream to the reactor inlet while the reactor is heated by the furnace such that reactor effluent flows from the reactor outlet and such that a predetermined and substantially constant reactor outlet temperature is produced;

(e) introducing the effluent from the reactor to an inlet of a cooler having an outlet such that the effluent flows through the cooler and exits the cooler and such that a cooler outlet temperature is produced which is less than the reactor outlet temperature;

(f) controlling, during at least a portion of (d), the concentration of the antifoulant in the feed gas based on the cooler outlet temperature.

2. A process as recited in claim 1 wherein an initial cooler outlet temperature at approximately the commencement of (d) or thereafter during (d) is designated as $T_1$ and any subsequent cooler outlet temperature is designated as $T_2$, and wherein $T_2-T_1=\Delta T$ and antifoulant concentration is controlled in (p) so as to maintain $\Delta T$ substantially within a range having a lower limit greater than zero, minimum $\Delta T$, and an upper limit, maximum $\Delta T$.

3. A process as recited in claim 2 wherein the feed gas comprises only steam.

4. A process as recited in claim 3 wherein minimum $\Delta T$ is in the range of about 1–20° F. and maximum $\Delta T$ is in the range of about 50–150° F.

5. A process as recited in claim 2 wherein the feed gas further comprises at least one saturated hydrocarbon which is cracked in the reactor during (d) to produce the corresponding unsaturated hydrocarbon.

6. A process as recited in claim 5 wherein minimum $\Delta T$ is in the range of about 1–10° F. and maximum $\Delta T$ is in the range of about 20–80° F.

7. A process as recited in claim 1 wherein in (f) antifoulant concentration is controlled automatically using a computer/controller.

* * * * *